US010005192B2

(12) United States Patent
Kulshreshtha

(10) Patent No.: US 10,005,192 B2
(45) Date of Patent: Jun. 26, 2018

(54) ELECTRIC HAIR CLIPPER

(71) Applicant: SKULL SHAVER, LLC, Moorestown, NJ (US)

(72) Inventor: Neel B. Kulshreshtha, Burlington Township, NJ (US)

(73) Assignee: Skull Shaver, LLC, Moorestown, NJ (US)

( * ) Notice: Subject to any disclaimer, the term of this patent is extended or adjusted under 35 U.S.C. 154(b) by 26 days.

(21) Appl. No.: 14/910,345

(22) PCT Filed: Mar. 12, 2014

(86) PCT No.: PCT/US2014/024000

§ 371 (c)(1),
(2) Date: Feb. 5, 2016

(87) PCT Pub. No.: WO2015/020696

PCT Pub. Date: Feb. 12, 2015

(65) Prior Publication Data

US 2016/0176060 A1 Jun. 23, 2016

Related U.S. Application Data

(63) Continuation-in-part of application No. 13/962,149, filed on Aug. 8, 2013, now Pat. No. 9,878,457.

(51) Int. Cl.
*B26B 19/28* (2006.01)
*B26B 19/38* (2006.01)

(52) U.S. Cl.
CPC ..... *B26B 19/3853* (2013.01); *B26B 19/28* (2013.01)

(58) Field of Classification Search
CPC ..... B26B 19/3853; B26B 19/28
USPC ..... 30/527
See application file for complete search history.

(56) References Cited

U.S. PATENT DOCUMENTS 1,201,317 A * 10/1916 Lishawa ..... B26B 21/527 30/291
2,060,520 A * 11/1936 Muros ..... B26B 21/32 30/526
2,102,142 A * 12/1937 Burnett ..... B26B 21/18 30/41
2,108,758 A * 2/1938 Emerson ..... B26B 21/30 30/526
2,648,129 A * 8/1953 Streeter ..... B26B 21/18 30/49
2,720,696 A * 10/1955 Wadsworth ..... B26B 19/14 30/41.5

(Continued)

*Primary Examiner* — Sean Michalski
(74) *Attorney, Agent, or Firm* — Norman E. Lehrer

(57) ABSTRACT

An electric hair clipper (10) includes a housing (12) containing an electrical source and drive-related components. A clipper mechanism (14) having a reciprocating clipper (16) is located beneath the bottom of the housing (12) but is spaced therefrom by a pivotal central hub (1 18) that extends downwardly from the bottom of the housing. The housing (12), central hub (118) and clipper mechanism (14) are arranged such that a person can hold the electric hair clipper by placing his or her fingers in the space between the housing (12) and the clipper mechanism (14) with the central hub (1 18) lying between two fingers and with the back of the person's fingers resting in a pair of elongated spaced apart recesses (26, 28) formed in the bottom of the housing (12) on opposite sides of the hub (118).

3 Claims, 5 Drawing Sheets

(56) References Cited

U.S. PATENT DOCUMENTS 2,835,030 A * 5/1958 Seller ..... B26B 21/32 30/526
3,045,342 A * 7/1962 Diehl ..... B26B 21/00 30/32
3,314,146 A * 4/1967 Cooksey ..... B26B 19/00 30/34.05
4,177,698 A * 12/1979 Greneker ..... A61B 17/3211 294/25
4,709,475 A * 12/1987 Phung ..... B26B 21/12 132/76.2
D304,773 S * 11/1989 Beuchat ..... D28/46
5,009,003 A * 4/1991 Grange ..... B26B 21/04 30/30
5,031,319 A * 7/1991 Althaus ..... B26B 21/522 30/526
5,038,479 A * 8/1991 Davis ..... B26B 27/007 30/113.1
5,520,616 A * 5/1996 Hofmeister ..... A61H 23/0263 128/898
6,018,877 A * 2/2000 Greene ..... B26B 21/222 30/298
6,029,356 A * 2/2000 Sprinkle ..... B26B 21/08 30/298
D426,918 S * 6/2000 Greene ..... D28/48
D444,915 S * 7/2001 Bianco ..... D28/45
6,308,416 B1 * 10/2001 Bosy ..... B26B 21/225 30/50
D455,865 S * 4/2002 Rizzuto, Jr. ..... D28/53
6,473,973 B2 * 11/2002 Laube ..... F01B 3/045 30/223
6,493,950 B1 * 12/2002 Kludjian ..... B26B 21/22 30/298
D601,301 S * 9/2009 Bao ..... D28/50
D663,898 S * 7/2012 Aulwes ..... B26B 21/52 D28/54
8,393,082 B2 * 3/2013 Shimizu ..... B26B 19/14 30/43.5
8,782,911 B1 * 7/2014 Greene ..... B26B 21/52 30/298
D710,542 S * 8/2014 Eagleton ..... B26B 21/52 D28/48
D717,492 S * 11/2014 Kulshreshtha ..... B26B 21/52 D28/53
D717,493 S * 11/2014 Kulshreshtha ..... B26B 21/52 D28/53
9,427,879 B2 * 8/2016 Wevers ..... B26B 19/063
2002/0083600 A1 * 7/2002 Donovan ..... B26B 21/14 30/526
2003/0033717 A1 * 2/2003 Cecil ..... B26B 21/527 30/50
2003/0084573 A1 * 5/2003 Kludjian ..... B26B 21/22 30/50
2003/0167644 A1 * 9/2003 Motta ..... B26B 21/165 30/526
2008/0034591 A1 * 2/2008 Fung ..... B26B 19/02 30/43.92
2008/0072430 A1 * 3/2008 Cafaro ..... B26B 19/06 30/45
2008/0155834 A1 * 7/2008 Li ..... B26B 19/04 30/210
2010/0287784 A1 * 11/2010 Qiu ..... B26B 19/14 30/527
2011/0167653 A1 * 7/2011 Psimadas ..... B26B 21/222 30/526
2011/0308087 A1 * 12/2011 Rehbein ..... B26B 19/06 30/34.1
2012/0090181 A1 * 4/2012 Broekhuizen ..... A45D 26/0023 30/123
2012/0110855 A1 * 5/2012 Allen, Sr. ..... B26B 19/146 30/43.6
2012/0124846 A1 * 5/2012 Hopfner ..... B26B 21/522 30/526
2012/0159795 A1 * 6/2012 Walmsley ..... B26B 19/3853 30/526
2012/0279073 A1 * 11/2012 Snow ..... B26B 19/3853 30/295
2013/0031794 A1 * 2/2013 Duff, Jr. ..... B26B 21/60 30/526
2013/0212885 A1 * 8/2013 Lyles ..... B26B 19/3853 30/42
2013/0255455 A1 * 10/2013 McCue ..... B26B 19/06 83/13
2015/0089814 A1 * 4/2015 Marut ..... F16C 11/10 30/42

* cited by examiner

ELECTRIC HAIR CLIPPER

CROSS-REFERENCE TO RELATED APPLICATIONS

This application is a continuation-in-part of U.S. patent application Ser. No. 13/962,149, filed Aug. 8, 2013.

TECHNICAL FIELD

The present invention is directed toward electric hair clippers or trimmers and, more particularly, toward electric hair clippers that allow a person to trim his or her own hair in areas such as the back of the neck that are otherwise difficult to do with conventional clippers.

BACKGROUND ART

Electric hair clippers generally include a hand-held housing that contains a motor and power supply-related components that drive a reciprocating trimming blade. The housing also provides a form that fits the user's hand sufficiently as a grip so as to allow the user to manipulate the hair clipper. Various types of clippers are well known in the art. In general, the clippers comprise an elongated housing with a reciprocating trimming blade at one end with the blade being perpendicular to the axis of the housing. While such conventional clippers are relatively easy to manipulate when trimming another person's hair, they are awkward to use on one's own hair and particularly the back of one's neck.

There is, therefore, a need for an electric hair clipper that allows a person to trim his or her own hair in areas such as the back of the neck that are otherwise difficult to do with conventional clippers.

Disclosure of the Invention

The present disclosure relates to an electric hair clipper that includes a housing containing an electrical source and drive-related components. A clipper mechanism having a reciprocating clipper is located beneath the bottom of the housing but is spaced therefrom by a central hub that extends downwardly from the bottom of the housing. The housing, central hub and clipper mechanism are arranged such that a person can hold the electric hair clipper by placing his or her fingers in the space between the housing and the clipper mechanism with the central hub lying between two fingers and with the back of the person's fingers resting in a pair of elongated spaced apart recesses formed in the bottom of the housing on opposite sides of the hub.

When the electric hair clipper of the present invention is held in the above described manner, it is possible to easily either grip the hair clipper with two fingers as between the thumb and index finger, or between the index and middle fingers and properly orient cutting clipper. This allows the person to easily trim areas such as the back of the neck that are otherwise difficult to do.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings forms that are presently preferred; it being understood that the invention is not intended to be limited to the precise arrangements and instrumentalities shown.

BEST MODE FOR CARRYING OUT THE INVENTION

Figure 1:
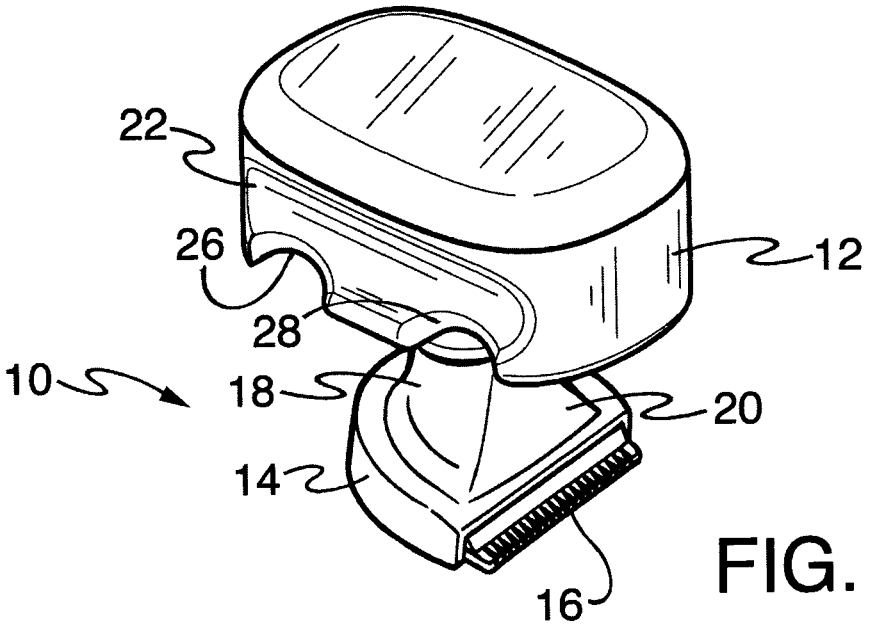
FIG. 1 is a top perspective view of a first embodiment of an electric hair clipper in accordance with the invention.
Figure 2:
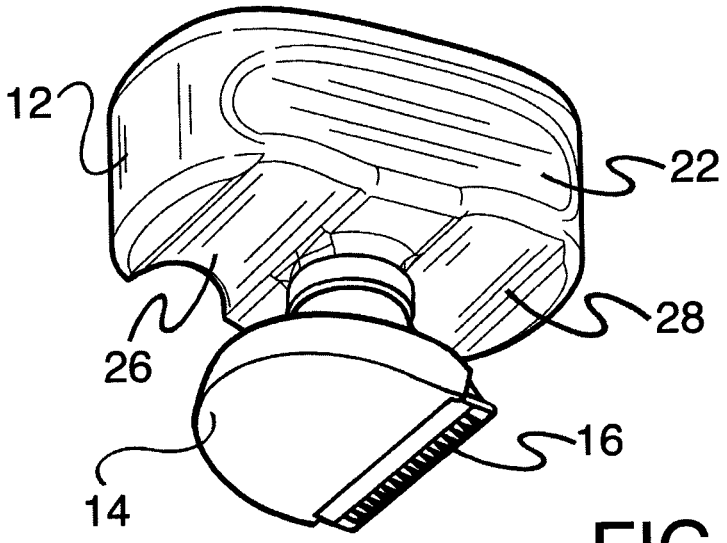
FIG. 2 is a bottom perspective view thereof.
Figure 3:
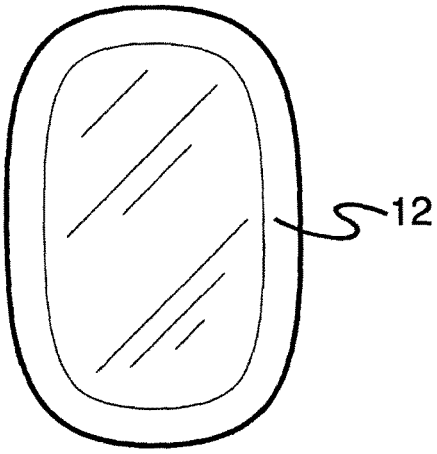
FIG. 3 is a top plan view thereof.
Figure 4:
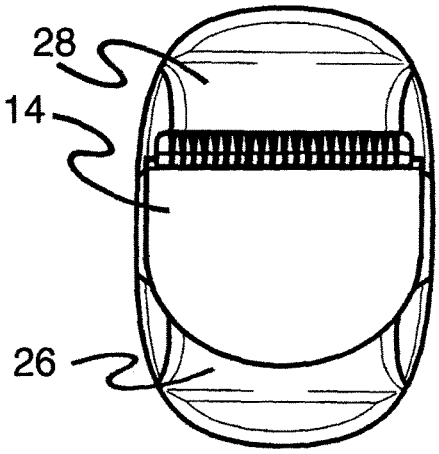
FIG. 4 is a bottom plan view thereof.

A more complete understanding of the components, processes, and apparatuses disclosed herein can be obtained by reference to the accompanying figures. These figures are intended to demonstrate the present disclosure and are not intended to show relative sizes and dimensions or to limit the scope of the exemplary embodiments.

Although specific terms are used in the following description, these terms are intended to refer only to particular structures in the drawings and are not intended to limit the scope of the present disclosure. It is to be understood that like numeric designations refer to components of like function.

The term "about" when used with a quantity includes the stated value and also has the meaning dictated by the context. For example, it includes at least the degree of error associated with the measurement of the particular quantity. When used in the context of a range, the term "about" should also be considered as disclosing the range defined by the absolute values of the two endpoints. For example, the range "from about 2 to about 4" also discloses the range "from 2 to 4."

In one embodiment, the present disclosure relates to a hair clipper that comprises a gripping means and a cutting clipper or trimmer, configured in such a manner that allows the hair clipper to be oriented with the grip portion above the cutter portion with space between them for a persons fingers, thus making it anatomically convenient to hold the hair clipper and trim one's own hair.

Referring now to the drawings in detail wherein like reference numerals have been used throughout the various figures to designate like elements, there is shown in FIGS. 1-8 a first embodiment of an electric hair clipper or trimmer constructed in accordance with the principles of the present invention and designated generally as 10.

Figure 5:
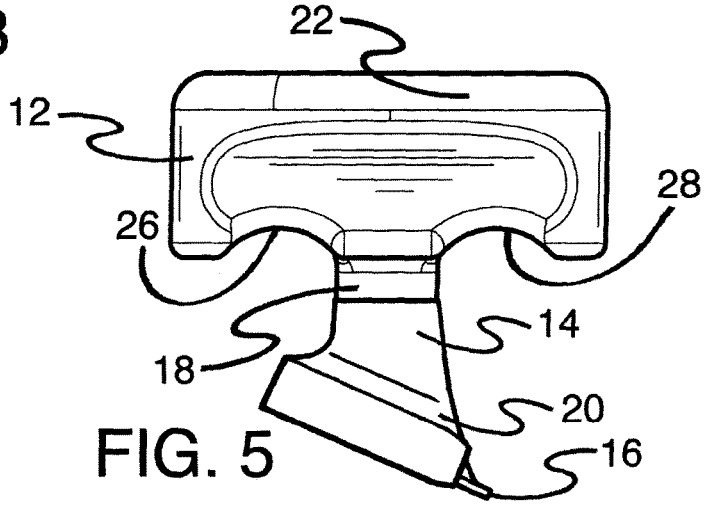
FIG. 5 is a left side elevational view thereof, the right side being the mirror image thereof.
Figure 6:
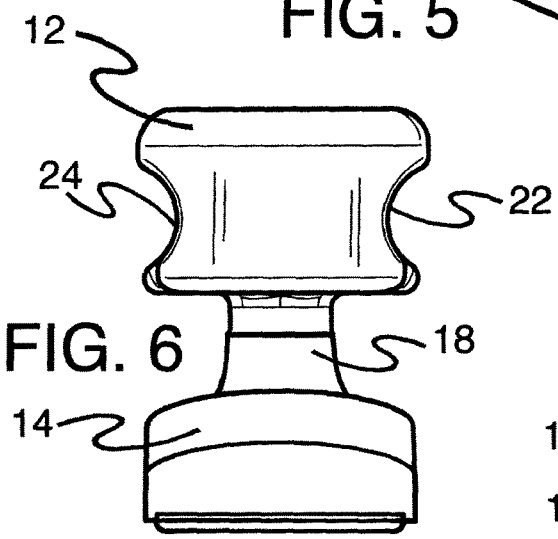
FIG. 6 is a rear elevational view thereof.
Figure 7:
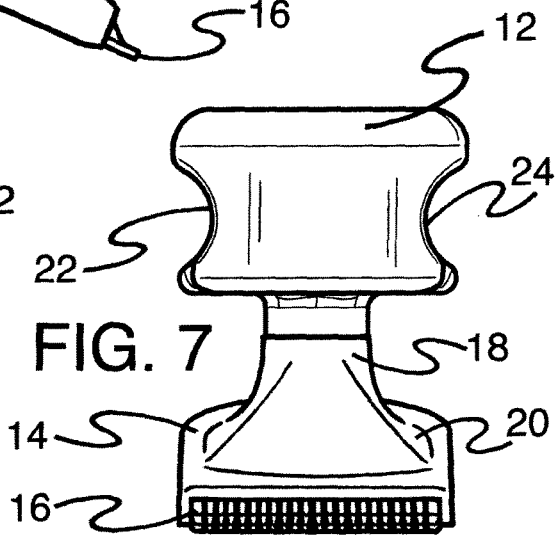
FIG. 7 is a front elevational view thereof.
Figure 8:
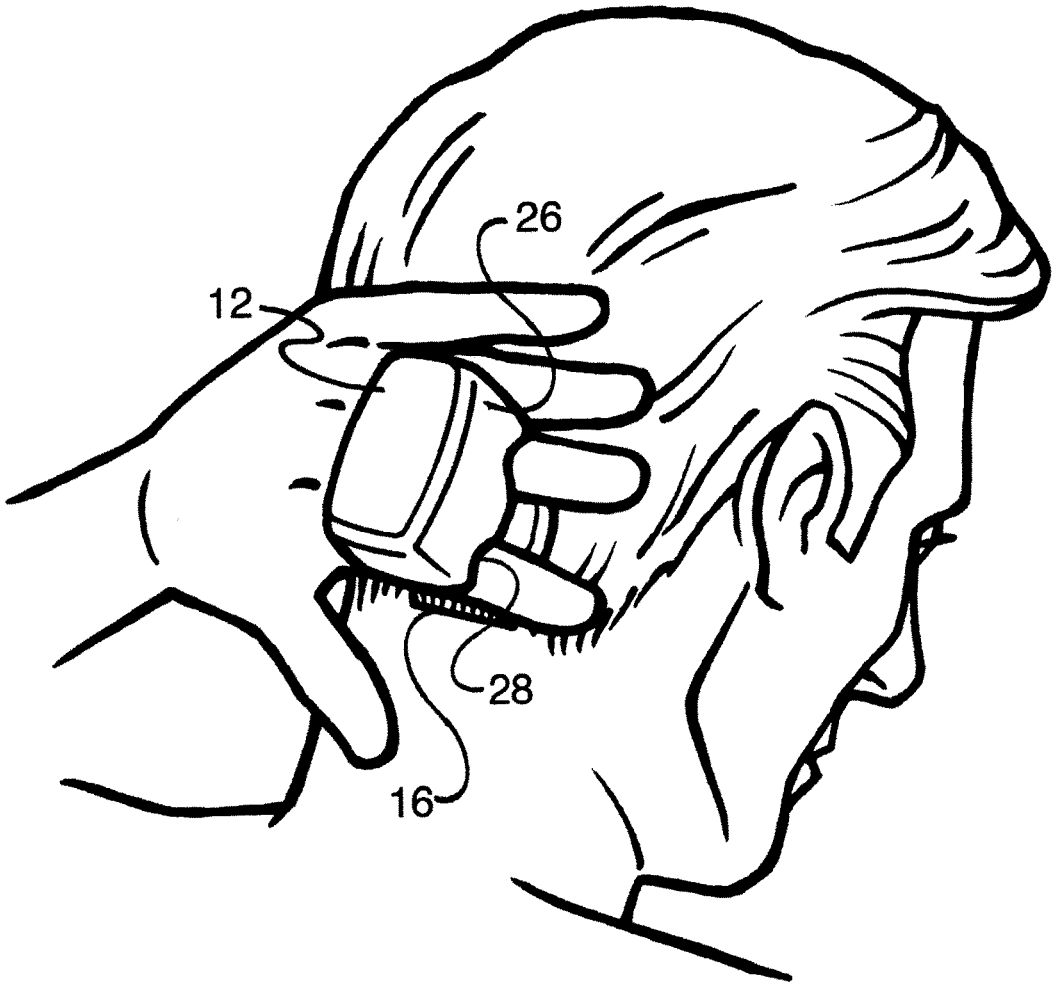
FIG. 8 is a perspective view showing how the electric clipper of the invention is held and used to trim one's hair.

The hair clipper 10 comprises an upper portion 12 that provides a substantially rectangularly shaped housing for a power source and motor related components, and a trimmer mechanism 14 that includes a reciprocating straight line trimmer 16. The connection between the motor and the trimmer head passes through the central hub 18 which may have an enlarged lower portion 20. The straight line trimmer 16 is, per se, conventional and is well known in the art. As shown in the figures and as is known in the art, the distal edge of the trimmer 16 (as shown at the right of FIG. 5 and the bottom on FIG. 6, for example) defines a straight line. The motor (not shown) is also mechanically coupled to the trimmer 16 in a known manner.

The motor, power supply and other related components along with the trimmer are not, per se, part of the present inventive concept. They are all individually common and well known in the art. Accordingly, detailed descriptions of the same are not believed to be necessary.

The housing 12 further comprises a particular form that provides a gripping means, and fits the hand in a comfortable manner. The gripping means includes a pair of elongated recesses in the form of parallel concave surfaces 22 and 24 formed on either side of the housing 12. The concave surfaces define a plane that is parallel to the line formed by the trimmer 16. A second pair of elongated recesses in the form of concave surfaces 26 and 28 are formed in the under surface of the housing 12 above the trimmer 16. The second pair of concave surfaces 26 and 28 are arranged to be perpendicular to the first pair of concave surfaces 22 and 24 and also define a plane that is parallel to the line defined by the trimmer 16.

Concave surfaces 22 and 24 are configured to allow the hair clipper 10 to be gripped between the thumb and tips of several of one's remaining fingers with the palm of one's hand overlying the housing 12. Holding the trimmer 10 in this manner will allow the user to trim sideburns or other easy to reach facial hairs. However, when it is desired to trim harder to reach areas such as the back of one's neck, the clipper 10 is held in the manner shown in FIG. 8.

As shown, the person places his or her fingers in the space between the housing 12 and the clipper mechanism 14 with the central hub 18 lying between two fingers and with the back of the person's fingers resting in the concave recesses or grooves 26 and 28. The person's fingers are also gripping the central hub 18. When the clipper is held in this manner, it can be seen that the clipper or trimmer 16 is in line with the person's fingers making it easy for the person to trim the back of his or her neck.

The second embodiment 110 of the invention shown in FIGS. 9 to 13 is very similar to the first embodiment shown in FIGS. 1 to 8 and operates in the same manner. The difference is primarily in the central hub section shown at 118. In the first embodiment, the central 18 was fixed. In the second embodiment, the central hub is comprised of two parts hinged or pivoted together.

More particularly, the central hub 118 is comprised of upper hub portion 130 and lower hub portion 120. Lower hub portion 120 includes an upwardly extending tongue 132 and the upper hub portion 130 includes a pair of downwardly extending ears 134 and 136 lying on either side of the tongue 132. A pin 138 extends through apertures (not shown) located in the tongue 132 and ears 134 and 136. This pivot or hinge arrangement allows for limited pivotal movement forward and back (as viewed in FIG. 11) between the housing 112 and the trimmer mechanism 114.

Figure 9:
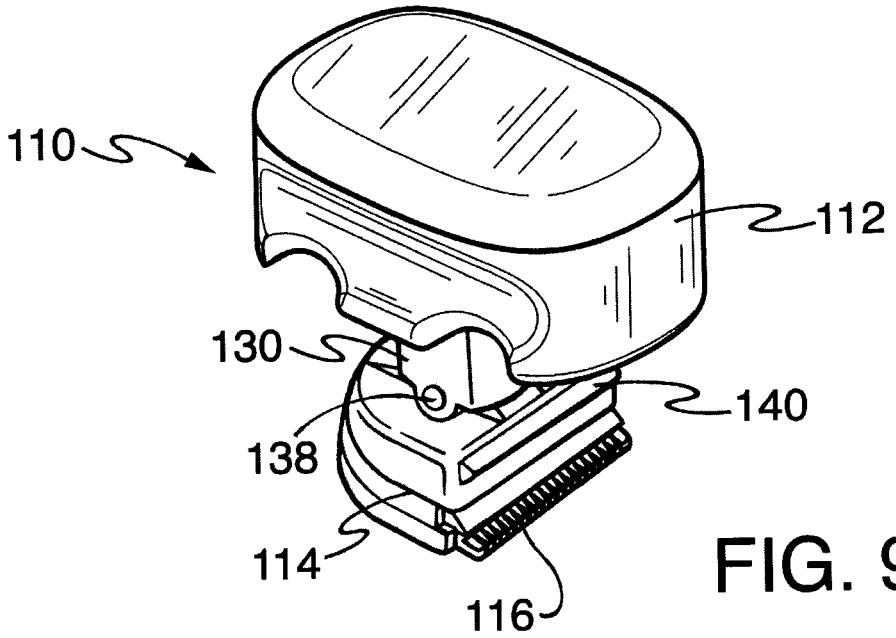
FIG. 9 is a top perspective view of a second embodiment of an electric hair clipper in accordance with the invention.
Figure 10:
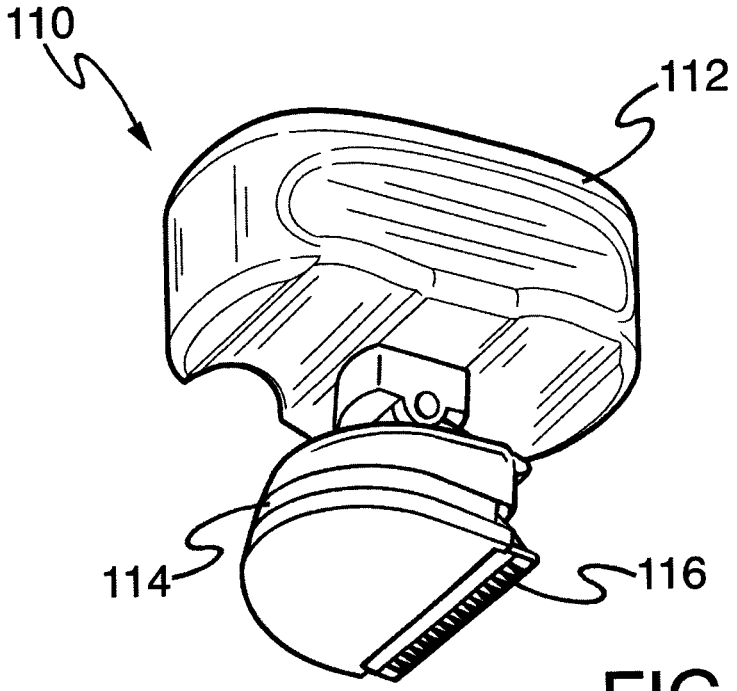
FIG. 10 is a bottom perspective view of the second embodiment.
Figure 11:
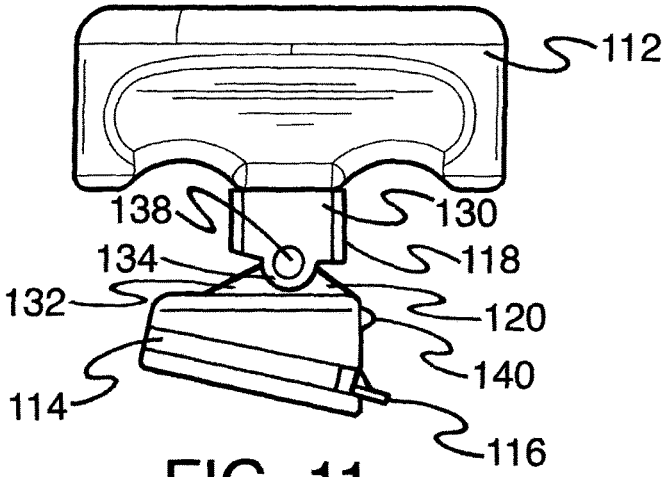
FIG. 11 is a left side elevational view of the second embodiment, the right side being the mirror image thereof.
Figure 12:
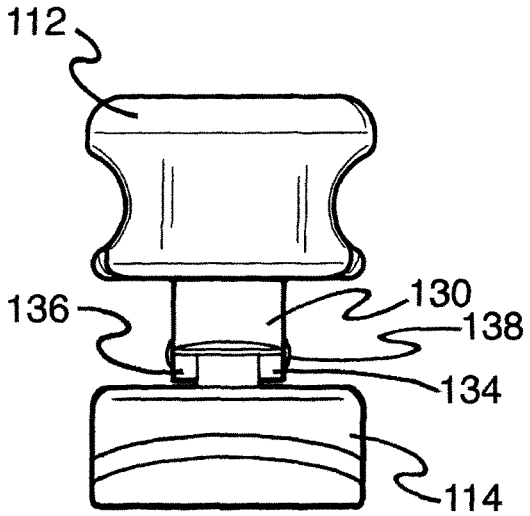
FIG. 12 is a rear elevational view of the second embodiment.
Figure 13:
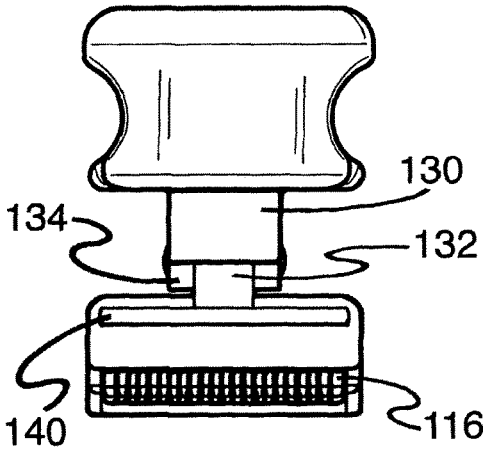
FIG. 13 is a front elevational view thereof.

In addition, and as best seen in FIGS. 9, 11 and 13, a rib 140 extends forwardly across the front wall 142 of the lower hub portion 120 just above the trimmer 116. In the preferred embodiment, the rib 140 extends entirely across the width of the lower hub portion 120. When the electric hair clipper or trimmer 110 is held, for example, in the manner shown in FIG. 8, the rib 140 functions to advise the user that his finger is close to the trimmer 116. This lets the user know that he is using the trimmer 110 properly and helps to prevent injuries.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. An electric hair clipper comprising:

a housing for containing an electrical source and drive-related components, said housing having a top surface and a bottom surface;

a clipper mechanism located beneath said bottom surface of said housing and spaced therefrom, said clipper mechanism including a reciprocating clipper having a distal edge defining a straight line;

a central hub having an upper portion connected to and extending downwardly from said bottom surface of said housing, said central hub having a lower portion connected to said clipper mechanism;

pivot means located between said upper portion and said lower portion of said central hub permitting said clipper mechanism to pivot relative to said housing, and said housing, central hub and clipper mechanism being arranged such that a person can hold the electric hair clipper by placing his or her fingers in the space between said housing and said clipper mechanism with the central hub lying between two fingers and with the bottom of the housing contacting the back of the person's fingers.

2. The electric hair clipper as claimed in claim 1 further including a pair of elongated spaced apart recesses formed in said bottom of said housing and being located on opposite sides of said hub and wherein the back of said person's fingers rest in said recesses.

3. The electric hair clipper as claimed in claim 1 further including a rib on said lower portion of said hub between said pivot means and said reciprocating clipper, said rib being engagable by a person's finger to indicate that the reciprocating clipper is near.

* * * * *